US006444377B1

(12) United States Patent
Jotcham et al.

(10) Patent No.: US 6,444,377 B1
(45) **Date of Patent: *Sep. 3, 2002**

(54) SECURITY FEATURES

(75) Inventors: Richard Bryan Jotcham, Trowbridge; Gerald Sidney Payne, Bath, both of (GB)

(73) Assignee: De La Rue International Ltd., Basingstoke (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/474,105

(22) Filed: Dec. 29, 1999

(30) Foreign Application Priority Data

Dec. 29, 1998 (GB) ..... 9828772

(51) Int. Cl.[7] ..... B41M 3/14; B42D 15/00; D21H 21/42

(52) U.S. Cl. ..... 430/10; 430/1; 430/2; 359/2; 283/96; 283/97

(58) Field of Search ..... 430/10, 1, 2; 283/94, 283/95, 96, 97; 359/2, 3

(56) References Cited

U.S. PATENT DOCUMENTS

| | | | | | |
|---|---|---|---|---|---|
| 3,802,724 A | | 4/1974 | Gosnell | ..... | 283/6 |
| 4,037,007 A | * | 7/1977 | Wood et al. | ..... | 428/199 |
| 4,161,449 A | * | 7/1979 | Smith et al. | ..... | 252/8.6 |
| 4,273,362 A | * | 6/1981 | Carrier et al. | ..... | 283/6 |
| 4,648,882 A | * | 3/1987 | Osberghaus et al. | ..... | 8/142 |
| 4,666,940 A | * | 5/1987 | Bischoff et al. | ..... | 514/544 |
| 4,726,608 A | * | 2/1988 | Walton | ..... | 283/96 |
| 5,346,258 A | * | 9/1994 | Behm et al. | ..... | 283/102 |
| 5,681,065 A | * | 10/1997 | Rua, Jr. et al. | ..... | 283/95 |
| 5,769,458 A | * | 6/1998 | Carides et al. | ..... | 283/95 |
| 5,921,585 A | * | 7/1999 | Isaka et al. | ..... | 283/95 |

FOREIGN PATENT DOCUMENTS

| | | | | |
|---|---|---|---|---|
| EP | 0192567 | * | 8/1986 | ..... 283/96 |
| EP | 0570634 | | 11/1993 | |
| GB | 2064575 | * | 6/1981 | |
| JP | 02-136299 | * | 5/1990 | ..... 283/95 |

* cited by examiner

*Primary Examiner*—Martin Angebranndt
(74) *Attorney, Agent, or Firm*—Dykema Gossett PLLC

(57) ABSTRACT

The invention relates to improvements in security features in paper and other substrates and in particular to an activatable feature to warn of tampering. The invention further relates to a security feature for a security document comprising at least one activatable layer and at least one visually apparent masking layer, said at least one activatable layer comprising a composition which is generally non-mobile but which becomes mobile when wetted with a liquid, said composition further including at least one detectable component, in which under dry conditions said at least one masking layer wholly covers the activatable layer and renders it non-detectable.

53 Claims, 2 Drawing Sheets

SECURITY FEATURES

BACKGROUND OF THE INVENTION

The invention relates to improvements in security features in paper and other substrates, and in particular to an activatable feature to warn of tampering.

Documents of value and means of identification, such as banknotes, passports, identification cards and the like, are vulnerable to copying or counterfeiting. The increasing popularity of colour photocopiers and other imaging systems, and the improving technical quality of colour photocopiers, has led to an increase in the counterfeiting of such documentation. There is, therefore, a need to improve the security features of such documentation, or paper, to add additional security features or to enhance the perceptions and resistance to simulation of existing features. Steps have already been taken to introduce optically variable features into such documentation which cannot be reproduced by a photocopier. Furthermore, features are now available which are discernible by the naked eye, but invisible to, or viewed differently by, a photocopier. Known examples of such security features include watermarks, embedded and windowed security threads, fluorescent pigments and the like.

However, in addition to attempting to reproduce security features, counterfeiters also endeavour to tamper with or remove information or print or other security indicators associated with documents by immersing the document in water or a solvent.

It is therefore an object of the present invention to provide an improved security feature for a security document which services as an indicator of tampering of the document.

SUMMARY OF THE INVENTION

According to the invention there is provided a security feature for a security document comprising at least one activatable layer and at least one visually apparent masking layer, the at least one activatable layer comprising a composition which is generally nonmobile but which becomes mobile when wetted with a liquid, the composition further including at least one detectable component, in which under dry conditions the at least one masking layer wholly covers the activatable layer and renders it nondetectable.

A security feature as claimed in claim 1 in which the composition becomes mobile when wetted with an aqueous liquid.

BRIEF DESCRIPTION OF THE DRAWINGS

A preferred embodiment of the present invention will now be described in detail, by way of example only, with references to the accompanying drawing in which.

DETAILED DESCRIPTION OF THE PREFERRED EMBODIMENTS

Figure 1:
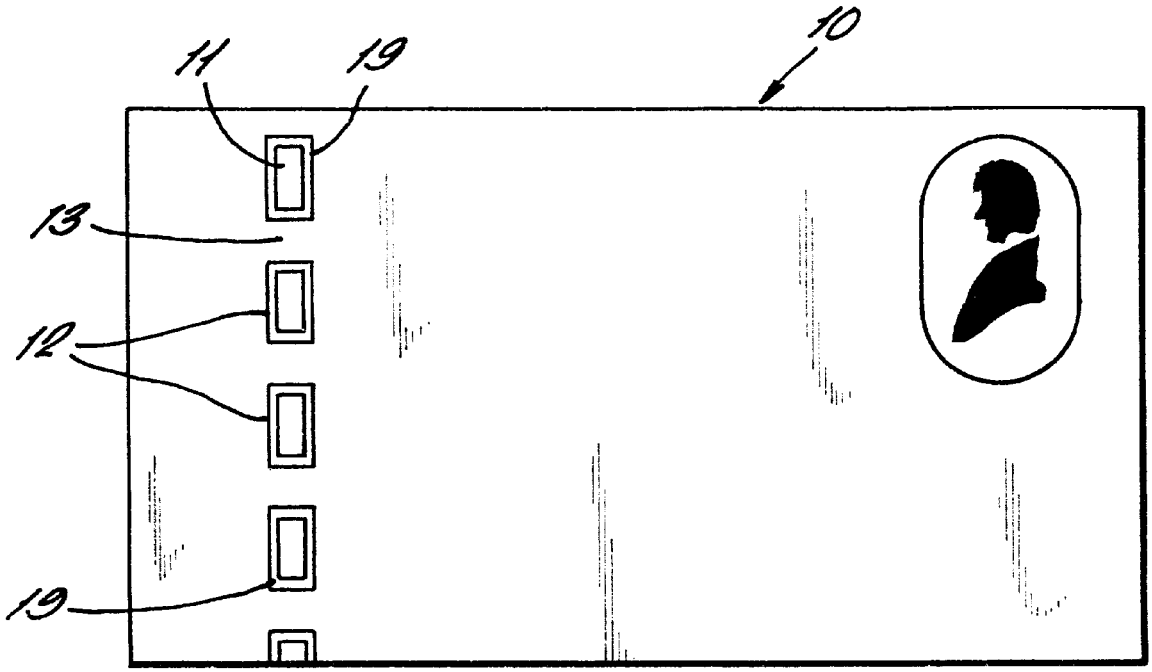
FIG. 1 is a plan view of a security document including the security feature of the present invention.

Referring to FIG. 1 there is illustrated a typical security document, such as a banknote, identification card, cheque, certificate, etc., which includes the security feature of the present invention in the form of a windowed security thread or element 11. The security element 11 is preferably made from a transparent colourless polyester film which is flexible and water-impermeable and which is provided with a layer of metal on one side thereof. Commonly used films for security elements 11 are vacuum deposited with aluminium or another suitable metal. The film is slit to form a number of individual security elements having a width typically of at least 0.5 mm and preferably at least 2 mm. However, the size is not relevant to the present invention. The security element 11 is inserted into a sheet of paper by one of a number of known methods. One of the most commonly used methods is using a cylinder mould paper machine, for example by the method disclosed in EP-A-0,059,056. In the resulting security paper the security element 11 is exposed on one side of the sheet at intervals along the length of the element 11, the region of exposure being referred to as a window 12. Bridges 13 are formed from paper fibres between the windows 12 to wholly embed the element 11 in those regions.

Figure 2:
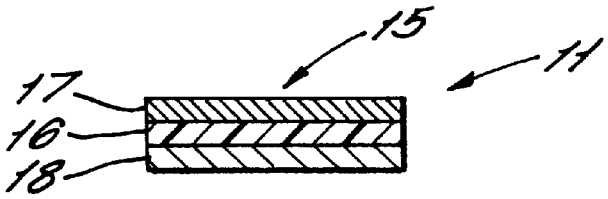
FIGS. 2 and 3 are cross sectional side elevations of a security element or thread comprising the security feature of FIG. 1.

In the present invention, the security element 11, as illustrated in FIG. 2, comprises the polyester film substrate 16, on an upper side of which is located a metal layer 17. ("Upper" being defined as being nearer to the surface 15 which is exposed in the window 12). A further "activatable" layer 18, which comprises a composition containing an activatable component is provided on an opposite "lower" side to the metal layer 17. The activatable component is one generally non-mobile, under normal conditions, but: which is soluble in a liquid such as a solvent to become mobile. The composition also includes a colourant.

In a security document 10 made from security paper containing the security feature according to the present invention, under normal conditions the security element 11 will be seen in reflected light in the windows 12 as bright shiny metallic blocks. The metal layer 17, however, wholly masks the activatable layer 18 so that it cannot be seen in the windows 12, so that the document 10 looks like a typical window thread document in both reflection and transmission.

However, if a counterfeiter were to attempt to tamper with the document 10 by immersing it in a liquid with the aim of removing the thread, printed information, or any other security features on the document 10, the activatable component which holds the colourant in place will become mobile in the solvent, allowing it to leach out into the surrounding paper to provide a highly visible frame or halo 19 stained with the colourant surrounding the windows 12. The activatable layer 18 is therefore no longer masked and is now clearly visible to the naked eye.

Figure 3:
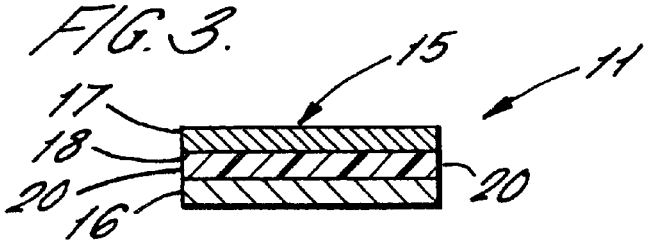

In an alternative embodiment of the feature described above, the security element 11 may have the construction shown in FIG. 3. In this security element 11, the transparent polyester film 16 has the activatable component layer 18 applied to its upper surface. A metal layer 17 is applied over the top of the activatable component layer 18. Since the polyester film 16 and the metal layer 17 are water impermeable, the solvent to activate layer 18 enters through the sides of the thread 20.

The metal layer 17 thus acts as a visible or dominant component the function of which is to mask an activatable component. The metal layer 17 may, therefore, in other embodiments of the present invention, be replaced by other layer, patches all of which serve these functions. The masking layer may be optically variable, such as irridescent or pearlescent coating, a UV dull or inhibiting substance such as a coating containing titanium dioxide or hindered phenol or an opaque coloured strip or layer.

In other embodiments of the present invention, the nature of the security feature may be something other than a security element 11. For example, it may be a hologram applied to the security paper overlying a patch of an activatable component to thereby mask the activatable component in normal conditions.

In another example the masking, or dominant, component may consist of a coating strip of opaque ink applied over a similar strip of the activatable component, or alternatively an OVI.

In yet another embodiment of the invention the dominant masking component is provided by a label applied to a paper or other substrate, and the activatable component is incorporated into the adhesive. When the security document bearing this embodiment of the invention is immersed in a solvent designed to dissolve adhesive, the activatable component becomes mobile and the colourant leaches out into and/or around the label.

Where the masking component itself is made from paper or another permeable substrate, the security document itself can be made of an impermeable substrate such as plastic. In this situation the water or solvent is able to permeate the masking layer to reach the activatable component.

A further embodiment of the invention may comprise a combination print, such as flexographic or screen printing.

In the first mentioned example the activatable component is described as including a colourant which on leaching out into the area around the thread 11 becomes visible to the naked eye. What is important, however, is that an element of the activatable component is clearly detectable whether by eye, under normal light, under UV light or IR light or with another type of machine or detector.

The composition may therefore alternatively contain a fluorescent substance which is invisible to the naked eye and is initially masked by an ultraviolet dull coating, instead of a layer of metal. After activation the frames 19 of the fluorescence will be clearly discernible from the windowed side of the document 10 when examined under ultraviolet light, although to the naked eye it will not be visible. On the reverse side of the document 10, a long strip of fluorescence can be clearly detected.

Other detectable components may alternatively include a non-bleachable dye, polar/non-polar or a pH sensitive component.

The security feature may include a plurality of activatable component features which may include different components which are activated by different liquids, e.g. one water soluble component, one solvent soluble component etc.

The security feature may also include a plurality of masking features being the same or different.

Some specific examples of the present invention will e described below.

EXAMPLE 1

In this example a stripe is applied to a paper substrate using a gravure coater. The stripe is formed from a composition which includes an optically variable ink that has been doped with a mixture of UV fluorescent water soluble component plus an ultraviolet inhibitor, such as a hindered phenol. Under normal conditions, this stripe is visible as an optically variable image in normal light and is UV dull in UV fluorescent light.

Immersing a document made from such paper in water or an aqueous eradicator causes the water mobile component to move. After activation, under normal light the strip remains optically variable. However under UV fluorescent light the strip is UV dull with a fluorescent halo appearing around the strip. When the document is turned over the back of the strip is distinctively UV fluorescent.

EXAMPLE 2

In this example, the document is readable using fluorescent bar code sorter. This involves detecting a preprinted fluorescent bar code which sorts the documents into denominations. Following activation, an additional fluorescent strip is produced which would cause the document to be rejected, thus providing machine detection of potentially tampered documents.

EXAMPLE 3

Figure 4:
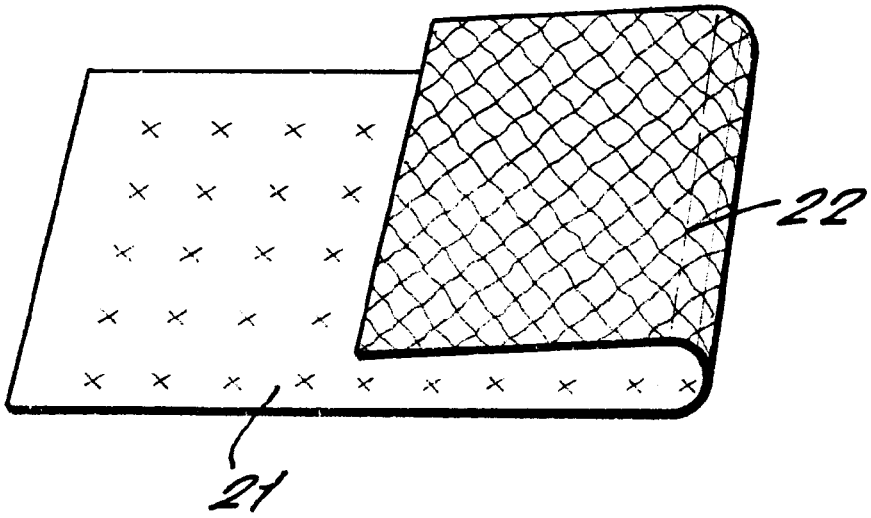
FIG. 4 is a schematic view of a holographic label including the security feature of the present invention.

As shown in FIG. 4, holographic label (21) is manufactured by a conventional embossing process. When the adhesive is applied to the back of the foil it is applied over a printed mesh of mobile component (22) such as a solvent soluble dye stuff. Thus the adhesion to the foil to the receptive substrate is not effected. On the immersion of the document in a solvent or water, the mobile component bleeds into the surrounding fibres creating a halo around the holographic label.

EXAMPLE 4

Figure 5:
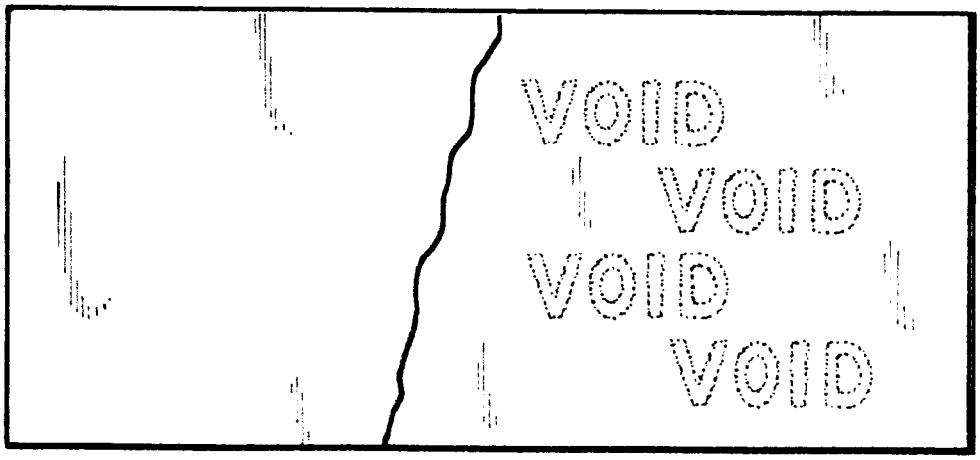
FIG. 5 is a plan view of security document including the security feature of the present invention having a UV element.

An ink is prepared containing a mixture of a UV dull chemical, such as a hindered phenolic or titanium dioxide and a UV fluorescent product such as Uvitex (trade mark). This ink is printed by a variety of techniques such as flexography, gravure or litho onto a UV dull paper, as shown in FIG. 5. The print will be a message, such as "void". Before immersion the document is viewed under UV light and found to be dull with no message showing, as shown on the left hand side of FIG. 5. On immersion in water or a solvent the fluorescent components separates from the print producing the word "void" in hollow letters, as shown on the right hand side of FIG. 5.

What is claimed is:

1. A security substrate for a security substrate document comprising a permeable base substrate security feature having at least one activatable layer and at least one visually apparent liquid impermeable masking layer, said masking layer comprising a security element which has a layer comprising a security element which has a layer of metal supported on a flexible strip, said at least one activatable layer comprising a composition which is generally non-mobile, said composition further including at least one detectable component, in which under dry conditions said at least one masking layer wholly covers the activatable layer and renders it non-detectable, wherein when the activatable layer is wetted with a liquid via the base substrate, the composition becomes mobile and leaches into the substrate surrounding the masking layer to thereby highlight the masking layer.

2. A security substrate as claimed in claim 1 in which the composition becomes mobile when wetted with an aqueous liquid.

3. A security substrate as claimed in claim 1 in which the composition becomes mobile when wetted with a liquid which is a solvent.

4. A security substrate as claimed in claim 1 further comprising a plurality of activatable layers each containing a different composition which becomes mobile when wetted with different tripes of liquid.

5. A security substrate as claimed in claim 1 in which the activatable layer is also supported on the flexible strip.

6. A security substrate as claimed in claim 1 further comprising a plurality of masking layers.

7. A security substrate as claimed in claim 1 in which the detectable component comprises a fluorescent dye.

8. A security substrate as claimed in claim 1 in which the detectable component comprises a coloured ink.

9. A security substrate as claimed in claim 1 in which the detectable component comprises a non-bleachable dye.

10. A security substrate as claimed in claim 1 in which the detectable component comprises a pH sensitive component.

11. A security substrate as claimed in claim 1 in which the detectable component comprises a polar component.

12. A security substrate as claimed in claim 1 in which the detectable component comprises a non-polar component.

13. A security substrate as claimed in claim 1 further comprising a plurality of detectable components.

14. A security substrate as claimed in claim 1 having two opposing surfaces for receiving identifying indicia.

15. A substrate as claimed in claim 14 in which the security feature is at least partially exposed in one or more windows in one or both of the surfaces of the substrate.

16. A substrate as claimed in claim 14 in which the security feature is wholly embedded within the substrate.

17. A substrate as claimed in claim 14 in which the security feature is applied to the surface of the substrate.

18. A substrate as claimed in claim 14 in which the activatable layer is contained within the substrate and the masking layer applied to one of the surfaces of the substrate.

19. A security substrate as claimed in claim 1 comprising a plurality of security features.

20. A security substrate as claimed in claim 1 in which the security feature is at least partially exposed in one or more windows in one or both of the surfaces of the substrate.

21. A security substrate for security document comprising an impermeable base substrate bearing a security feature having at least one activatable layer and at least one visually apparent liquid permeable masking layer made of paper, said at least one activatable layer comprising a composition which is generally non-mobile, said composition further including at least one detectable component, in which under dry conditions said at least one masking layer wholly covers the activatable layer and renders it non-detectable, wherein when the activatable layer is wetted with a liquid via the masking layer the composition become mobile and leaches through the masking layer to thereby highlight it with respect to the surrounding substrate.

22. A security substrate as claimed in claim 21 in which the composition becomes mobile when wetted with an aqueous liquid.

23. A security substrate as claimed in claim 21 in which the composition becomes mobile when wetted with a liquid which is a solvent.

24. A security substrate as claimed in claim 21 further comprising a plurality of activatable layers each containing a different composition which becomes mobile when wetted with different types of liquid.

25. A security substrate as claimed in claim 21 further comprising a plurality of masking layers.

26. A security substrate as claimed in claim 21 in which the detectable component comprises a fluorescent dye.

27. A security substrate as claimed in claim 21 in which the detectable component comprises a coloured ink.

28. A security substrate as claimed in claim 21 in which the detectable component comprises a non-bleachable dye.

29. A security substrate as claimed in claim 21 in which the detectable component comprises a pH sensitive component.

30. A security substrate as claimed in claim 21 in which the detectable component comprises a polar component.

31. A security substrate as claimed in claim 21 in which the detectable component comprises a nonpolar component.

32. A security substrate as claimed in claim 21 further comprising a plurality of detectable components.

33. A security substrate as claimed in claim 21 having two opposing surfaces for receiving identifying indicia.

34. A substrate as claimed in claim 33 in which the security feature is wholly embedded within the substrate.

35. A substrate as claimed in claim 33 in which the security feature is applied to the surface of the substrate.

36. A substrate as claimed in claim 33 in which the activatable layer is contained within the substrate and the masking layer applied to one of the surfaces of the substrate.

37. A substrate as claimed in claim 33 comprising a plurality of security features.

38. A security substrate for a security document comprising a permeable base straight and a security feature having at least one activatable layer and at least one visually apparent liquid impermeable masking layer, said masking layer comprising an optically variable layer, said at least one activatable layer comprising a composition which is generally non-mobile, said composition further including at least one detectable component, in which under dry conditions said at least one masking layer wholly covers the activatable layer and renders it non detectable, wherein when the activatable layer is wetted with a liquid via the base substrate, the composition becomes mobile and leaches into the security substrate surrounding the masking layer to thereby highlight the masking layer.

39. A security substrate as claimed in claim 38 wherein the optically variable masking layer comprises a hologram or holographic image.

40. The security substrate as claimed in claim 38 in which the optically variable masking layer comprises an optically variable ink.

41. A security substrate as claimed in claim 38 in which the optically variable masking layer comprises an iridescent coating.

42. A security substrate as claimed in claim 38 in which the optically variable masking layer comprises a pearlescent coating.

43. A security substrate as claimed in claim 38 in which the composition becomes mobile when wetted with an aqueous liquid.

44. A security substrate as claimed in claim 38 in which the composition becomes mobile when wetted with a liquid which is a solvent.

45. A security substrate as claimed in claim 38 further comprising a plurality of activatable layers each containing a different composition which becomes mobile when wetted with different types of liquid.

46. A security substrate as claimed in claim 38 in which the detectable component comprises a fluorescent dye.

47. A security substrate as claimed in claim 38 in which the detectable component comprises a non-bleachable dye.

48. A security substrate as claimed in claim 38 in which the detectable component comprises a pH sensitive component.

49. A security substrate as claimed in claim 38 in which the detectable component comprises a polar component.

50. A security substrate as claimed in claim 38 in which the detectable component comprises a non-polar component.

51. A security substrate as claimed in claim 38 further comprising a plurality of detectable components.

52. A security substrate as claimed in claim 38 having two opposing surfaces for receiving identifying indicia.

53. A security substrate as claimed in claim 38 comprising a plurality of security features.

* * * * *